US010177491B2

(12) United States Patent
Davies et al.

(10) Patent No.: US 10,177,491 B2
(45) Date of Patent: Jan. 8, 2019

(54) CONNECTOR ASSEMBLY

(71) Applicant: AB Connectors Ltd, Rhondda Cynon Taff (GB)

(72) Inventors: Marcus Davies, Rhondda Cynon Taff (GB); Andrew Gardner, Rhondda Cynon Taff (GB); David Whitworth, Rhondda Cynon Taff (GB)

(73) Assignee: AB CONNECTORS LTD, Rhondda Cynon Taff, Wales (GB)

( * ) Notice: Subject to any disclaimer, the term of this patent is extended or adjusted under 35 U.S.C. 154(b) by 0 days.

(21) Appl. No.: 15/783,902

(22) Filed: Oct. 13, 2017

(65) Prior Publication Data

US 2018/0040975 A1 Feb. 8, 2018

Related U.S. Application Data

(63) Continuation of application No. PCT/GB2016/051044, filed on Apr. 14, 2016.

(30) Foreign Application Priority Data

Apr. 15, 2015 (GB) ..... 1506418.1
Sep. 15, 2015 (GB) ..... 1516325.6

(51) Int. Cl.
*H01R 13/62* (2006.01)
*H01R 13/73* (2006.01)
(Continued)

(52) U.S. Cl.
CPC ..... *H01R 13/6205* (2013.01); *H01R 13/629* (2013.01); *H01R 13/73* (2013.01); *H01R 13/6272* (2013.01); *H01R 13/6273* (2013.01)

(58) Field of Classification Search
CPC ..... H01R 13/6205; H01R 11/30; H01R 13/24
(Continued)

(56) References Cited

U.S. PATENT DOCUMENTS 4,025,964 A * 5/1977 Owens ..... A61M 39/0247 128/899
4,118,090 A * 10/1978 Del Mei ..... G01R 1/0735 439/374
(Continued)

FOREIGN PATENT DOCUMENTS

EP 2757639 A1 7/2014
GB 2433843 7/2007
(Continued)

OTHER PUBLICATIONS

International Search Report and Written Opinion dated Jul. 13, 2016 on related PCT Application No. PCT/GB2016/051044 filed Apr. 14, 2016.
(Continued)

*Primary Examiner* — Gary F Paumen
(74) *Attorney, Agent, or Firm* — EIP US LLP

(57) ABSTRACT

There is described a connector assembly having a first connector part and a second connector part. At least one of the first connector part and the second connector part comprises at least one magnet for providing an attractive force between the first connector part and the second connector part to align the first connector part and the second connector part in a connected state. The first connector part comprises a guide track and the second connector part comprises a follower, the guide track being shaped to guide movement of the follower, under the influence of said attractive force, to a retaining position in which the follower engages an abutment surface on the first connector part to provide a retaining mechanism for retaining the first connector part and the second connector part in the connected state.

13 Claims, 7 Drawing Sheets

(51) Int. Cl.
*H01R 13/627* (2006.01)
*H01R 13/629* (2006.01)

(58) Field of Classification Search
USPC ..... 439/39, 37
See application file for complete search history.

(56) References Cited

U.S. PATENT DOCUMENTS 5,829,987 A * 11/1998 Fritsch ..... H01R 13/7037 439/38
6,030,229 A * 2/2000 Tsutsui ..... H01R 13/6205 336/90
6,129,559 A * 10/2000 Hirata ..... H01L 24/72 174/253
8,460,007 B1 * 6/2013 Xie ..... H01R 13/6205 439/289
2005/0255719 A1 * 11/2005 Heidlein ..... H01R 13/24 439/39
2006/0051981 A1 * 3/2006 Neidlein ..... H01R 13/6205 439/39
2009/0215283 A1 8/2009 Du
2011/0171837 A1 * 7/2011 Hardisty ..... H01R 13/6205 439/39
2014/0363988 A1 * 12/2014 An ..... G06F 1/1632 439/39

FOREIGN PATENT DOCUMENTS

TW 201234720 A 8/2012
WO 2008068241 A1 6/2008

OTHER PUBLICATIONS

United Kingdom Search Report dated Aug. 19, 2015 on related British Application No. GB 1506418.1, filed Apr. 15, 2015.

* cited by examiner

CONNECTOR ASSEMBLY

CROSS-REFERENCE TO RELATED APPLICATIONS

This application is a continuation of International Application No. PCT/GB2016/051044, filed Apr. 14, 2016, which claims priority to United Kingdom Application No. GB 1506418.1, filed Apr. 15, 2015 and to United Kingdom Application No. GB 1516325.6, filed Sep. 15, 2015. Each of the above-referenced patent applications is incorporated by reference in its entirety.

BACKGROUND OF THE INVENTION

Field of the Invention

The present invention relates to a connector assembly. The invention has particular, but not exclusive, relevance to an electrical connector assembly for connecting an electrical component to a garment having electrical circuitry provided therein.

Description of the Related Technology

There has been increasing interest in "wearable technology" in which electrical components and/or interconnects are incorporated within textiles. For example, electrical components such as keyboards, antennas and sensors have been incorporated in pieces of cloth. As another example, a wire loom for providing power to and/or enabling signaling between multiple electrical components has been woven into textile material. The textile electrical components can be part of, or be mounted on, garments. This is particularly advantageous when a person is required to carry many electrical devices, for example a soldier in a technologically advanced army, due to the reduced weight and the reduced risk of cables or wires snagging.

Preferably, electrical components can be readily connected and disconnected from the textile wire loom within or forming part of the garment. For example, such a modular arrangement allows for selective repair or upgrading of individual electrical components. Further, the electrical components can be connected to external electrical circuitry, or the textile wire loom can be connected to external electrical circuitry. Existing connector technology is not, however, well suited to connections to textile components. The present invention addresses the problem of providing a new type of connector that is better suited to connecting textile electrical components or connecting with textile electrical components, along with other potential applications.

SUMMARY

According to a first aspect of the present invention, there is provided a connector assembly comprising a first connector part and a second connector part. At least one of the first connector part and the second connector part comprises at least one magnet for providing an attractive force between the first connector part and the second connector part to align the first connector part and the second connector part in a connected state. The first connector part comprises a guide track and the second connector part comprises a follower, the guide track being shaped to guide movement of the follower, under the influence of said attractive force, to a retaining position in which the follower engages an abutment surface on the first connector part to provide a retaining mechanism for retaining the first connector part and the second connector part in the connected state. In this way, there is provided a magnetic alignment mechanism which automatically aligns the first connector part with the second connector part in a connected state and relative movement of the first connector part away from the second connector part is inhibited.

According to a second aspect of the invention, there is provided a connector assembly comprising a first connector part and a second connector part. The first connector part has a first planar connection surface and the second connector part has a second planar connection surface. The first connector part has a first magnet having a first magnetic axis aligned parallel to the plane of the first planar connection surface and the second connector part has a second magnet having a second magnetic axis aligned parallel to the second planar connection surface. In this way, when the first magnetic axis and the second magnetic axis are aligned in the same direction the first magnet and the second magnet produce a repulsive force to repel the first connector part and the second connector part from each other and wherein when the first magnetic axis and the second magnetic axis are aligned in opposite directions the first magnet and the second magnet produce an attractive force to attract the first connector part and the second connector part to each other. By making the configuration in which the first magnetic axis and the second magnetic axis are aligned in opposite directions correspond to correct alignment of the first connector part and the second connector part, misalignment of the first connector part and the second connector part is inhibited.

Further features and advantages of the invention will become apparent from the following description of preferred embodiments of the invention, given by way of example only, which is made with reference to the accompanying drawings.

DETAILED DESCRIPTION OF CERTAIN INVENTIVE EMBODIMENTS

Figure 2:
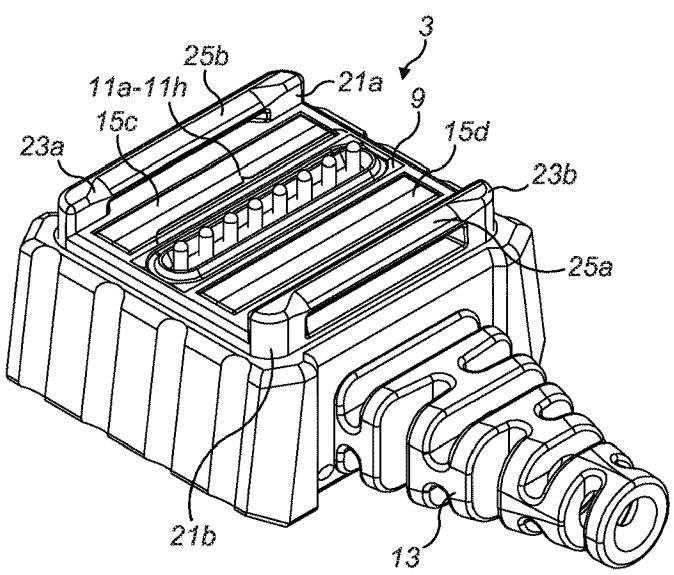
FIG. 2 shows a perspective view of a male part of the connector assembly according to the first embodiment of the invention.
Figure 1:
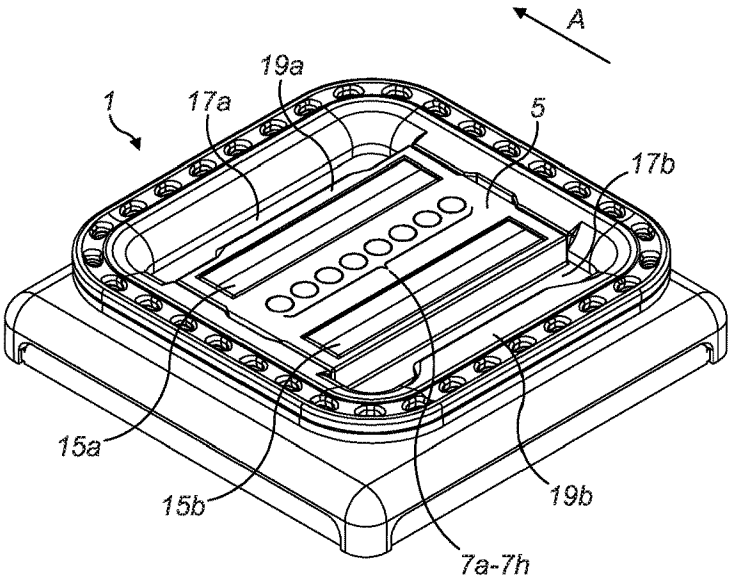
FIG. 1 shows a perspective view of a female part of a connector assembly according to a first embodiment of the invention.

As shown in FIGS. 1 and 2, a connector assembly according to a first embodiment of the present invention has a female receptacle 1 and a male plug 3. In this embodiment, the female receptacle 1 forms part of a wearable garment incorporating a wire loom (not shown) and the male plug 3 forms part of a textile electrical component (not shown). For example, in an embodiment the wearable garment is a shirt and the textile electrical component is a keyboard that can be mounted onto the shirt and connected to the wire loom forming part of the shirt by connecting the male plug 3 to the female receptacle 1.

The female receptacle 1 has a first planar connection surface 5 having a linear array electrical contacts 7*a*-7*h* formed therein arranged in a straight line. The electrical contacts 7 are in electrical connection with respective wires in the wire loom within the wearable garment. As shown in FIG. 1, the female part 1 is generally planar with a square shape, with two edges of the square shape being aligned parallel to the array of electrical contacts 7 and the other two edges of the square shape being arranged perpendicular to the array of electrical contacts 7. It will be appreciated that the wearable garment is also generally planar, and therefore the female part 1 is well suited for incorporating into a wearable garment.

The male plug 3 has a second planar connection surface 9 having a linear array of sprung electrical contacts 11*a*-11*h* mounted thereon in a straight line such that in a relaxed state the sprung electrical contacts 11 protrude perpendicular to the second planar connection surface 9 but in a compressed state the sprung electrical contacts 11 retract into the body of the male plug 3. The sprung electrical contacts 11 are connected to wires within a cable (not shown) that is attached to the male plug 3 via a cable bend relief 13. The male plug 3 is generally square in cross-section parallel to the second planar connection surface 9 with two edges of the square being aligned parallel to the array of sprung electrical contacts 11 and the other two edges of the square being arranged in a line perpendicular to the array of sprung electrical contacts 11. As shown in FIG. 2, the male plug 3 is a right angle connector component, i.e. the direction of insertion of the cable into the male plug 3 is generally at an angle of 90° to the orientation of the sprung electrical contacts 11. In this way, the thickness of the male plug 3 is largely governed by the dimensions of the cable bend relief 13. It will be appreciated that a textile electrical component is generally planar, and therefore the male plug 3 is well suited for mounting onto the textile electrical component by being a right angle connector.

The electrical contacts 7 of the female receptacle 1 and the sprung electrical contacts 11 of the male plug 3 are arranged so that when the male plug 3 is mounted to the female receptacle 1 in the connected state, each of the sprung electrical contacts 11 engages a respective different electrical contact 7 of the female receptacle 1 to effect an electrical connection between the textile electrical component and a wire in the wire loom within the wearable garment. As will be discussed hereafter, a magnetic aligning and retaining mechanism is utilized to facilitate correct alignment between the male plug 3 and the female receptacle 1, and also to retain the male plug 3 and the female receptacle 1 in the connected state. In particular, magnetic force is used to guide the male plug 3 into correct alignment with the female receptacle 1 to put the male plug 3 and the female receptacle 1 into the connected state, and when in the connected state the male plug 3 is retained by the female receptacle 1 such that movement of the male plug 3 away from the female receptacle 1 in a direction perpendicular to the first planar connection surface 5 is inhibited.

To provide the magnetic force for the magnetic aligning and retaining mechanism, first and second magnets 15*a*, 15*b* are formed in the first planar connection surface 5 of the female receptacle 1, and third and fourth magnets 15*c*, 15*d* are formed in the second planar connection surface 9 of the male part 3. The first magnet 15*a* has an elongated shape and is provided to one side of the linear array of electrical contacts 7 with the longitudinal axis aligned with the linear array of electrical contacts 7, and the second magnet 15*b* also has an elongated shape and is provided to the other side of the linear array of electrical contacts 7 with the longitudinal axis aligned with the linear array of electrical contacts 7. The respective magnetic axes for the first and second magnets 15*a*, 15*b* are aligned in the same direction in the plane of the first planar connection surface 5 perpendicular to the linear array of electrical contacts 7. Similarly, the third magnet 15*c* has an elongated shape and is provided to one side of the linear array of sprung electrical contacts 11 with the longitudinal axis aligned with the linear array of sprung electrical contacts 11, and the fourth magnet 15*d* also has an elongated shape and is provided to the other side of the linear array of sprung electrical contacts 11 with the longitudinal axis aligned with the linear array of sprung electrical contacts 11. The respective magnetic axes for the third and fourth magnets 15*c*, 15*d* are aligned in the same direction in the plane of the second planar connection surface 5 perpendicular to the linear array of sprung electrical contacts 11.

As will be discussed hereafter, in the correct orientation of the male plug 3 relative to the female receptacle 1, the magnetic axes of the first and second magnets 15*a*,15*b* are in a direction opposite to the magnetic axes of the third and fourth magnets 15*c*,15*d*, and an attractive force is generated when the male plug 3 is brought near the female receptacle 1 that urges the first planar connection surface 5 into contact with the second planar connection surface 9 such that the sprung electrical contacts 11 engage the electrical contacts 7. If, however, the magnetic axes of the first and second magnets 15*a*,15*b* are in the same direction as the magnetic axes of the third and fourth magnets 15*c*,15*d*, then a repulsive force is generated when the male plug 3 is brought near the female receptacle 1 that urges the first planar connection surface 5 away from the second planar connection surface 9.

As shown in FIG. 1, a first recess 17*a* and a second recess 17*b* are formed in the first planar connection surface 5. The first and second recesses 17*a*, 17*b* are generally rectilinear and are provided at opposing ends of the first planar connection surface 5 with the first and second magnets 15*a*, 15*b* and the linear array of electrical contacts 7 provided therebetween. The first and second recesses 17*a*, 17*b* are aligned parallel to the first and second magnets 15*a*, 15*b* and the linear array of electrical contacts 7. The first recess 17*a* has a first lip portion 19*a* overhanging a portion of the first recess 17*a* at the longitudinal edge of the first recess 17*a* proximal to the first magnet 15*a*, and the second recess 17*b* has a second lip portion 19*b* overhanging a portion of the second recess 17*b* at the longitudinal edge of the second recess 17*b* distal from the second magnet 15*b*. The first and second lip portions 19 have outwardly-facing surfaces that are oblique to the first planar connection surface 5.

As shown in FIG. 2, a first projection 21*a* and a second projection 21*b* project generally perpendicularly out of the second planar connection surface 9. The first and second projections 21*a*, 21*b* are arranged parallel with the linear array of sprung electrical contacts 11, with the linear array of sprung electrical contacts 11 and the third and fourth magnets 15*c*, 15*d* being provided between the first and second projections 21*a*, 21*b*. A lug portion 23*a*,23*b* is formed at the end of each of the first and second projections 21*a*,21*b* distal from the second projection surface 9. Each lug portion projects in a direction generally parallel to the plane of the second planar connection surface 9. Each lug portion 23 has an outwardly-facing contact surface 25*a*,25*b* facing away from the second planar connection surface at an oblique angle to the second planar connection surface, and an inwardly-facing contact surface that is generally parallel with the second planar contact surface 9.

In brief, when the male plug 3 is placed near to the female receptacle 5 in the correct orientation, the resultant attractive magnetic force brings the outwardly-facing contact surfaces 25 on the lug portions 23 of the male plug 3 into contact with the outwardly-facing surfaces of the lip portions 19. The reaction force at the contact points moves the male plug 3 transversely relative to the first planar connection surface 5 of the female receptacle 1 in the direction A indicated in FIG. 1. This brings the sprung electrical contacts 11 out of alignment with the electrical contacts 7, and the sprung electrical contacts 11 retract on contact with the first planar surface 5. As the lug portions 23 round the edge of the lip portions 19, a transverse component of the magnetic force moves the lug portions 23 into the portions of the recesses 17 under the lip portions 19 until the male plug 3 is in correct alignment with the female receptacle 1. In this correct alignment, the sprung electrical contacts 11 are pressed into the electrical contacts 7 of the female receptacle 1, and the male plug 3 and female receptacle 1 are in the connected state. In the connected state, the inwardly-facing surfaces of the lip portions 19 engage the inwardly-facing surfaces of the lug portions to retain the male plug 3 in the female receptacle 1. In this way, the inwardly-facing surfaces of the lip portions 19 act as abutment surfaces.

It will be appreciated that the movement of the male plug 3 relative to the female receptacle 5 into correct alignment requires no deformation/flexing of any portion of the male plug 3 and the female receptacle 5. In addition, the male plug 3 can be disengaged from the female receptacle 5 without requiring any deformation/flexing of any portion of the male plug 3 and the female receptacle 5. The absence of any deformation or flexing both makes the connector assembly less prone to breakage through repeated engaging and disengaging operations weakening deformed/flexed portions, and also removes the need to provide a manual mechanism to deform/flex one or more portions of the male plug 3 and/or the female receptacle 5 to disengage the male plug 3 from the female receptacle 5.

Figure 3:
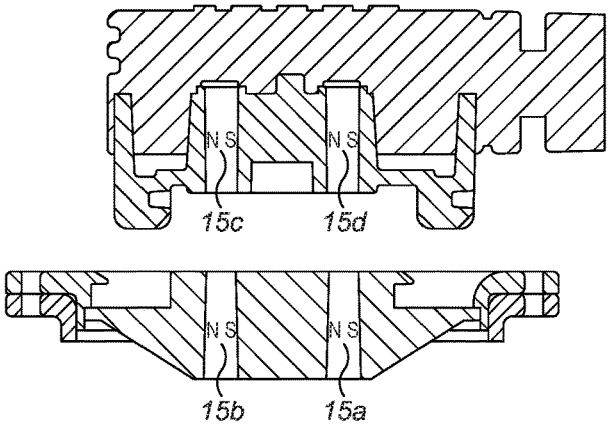
FIGS. 3 to 5 show the female part and the male part arranged relative to each other in a misaligned configuration.
Figure 4:
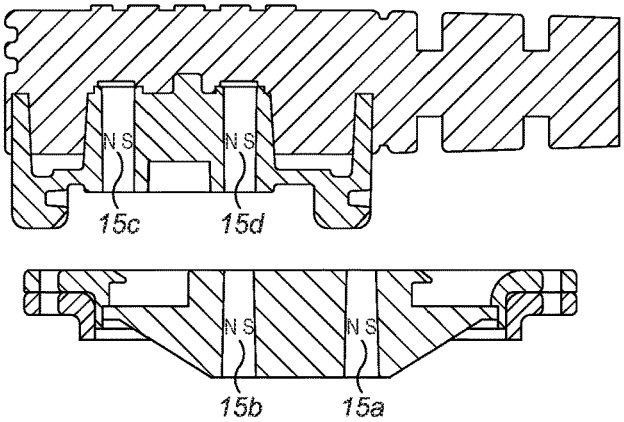
Figure 5:
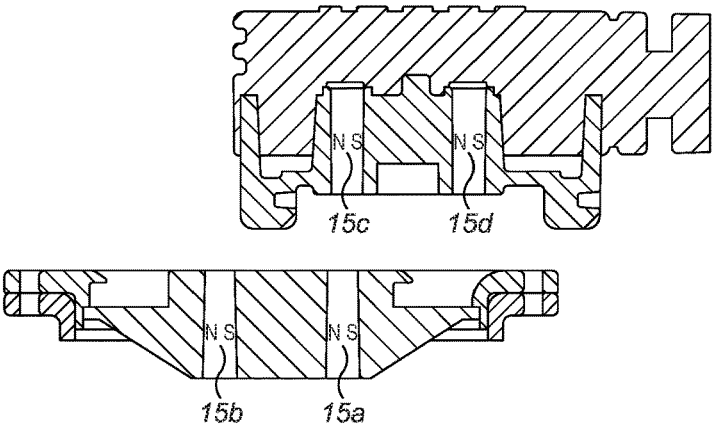

FIGS. 3 to 5 schematically illustrate the male plug 3 positioned opposite the female receptacle 1 in incorrect orientations. In particular, the male plug 3 is in an orientation in which the magnetic axes of the first and second magnets 15*a*,15*b* are in the same direction as the magnetic axes of the third and fourth magnets 15*c*,15*d*. FIG. 3 shows an arrangement in which the third magnet 15*c* is above the second magnet 15*b* and the fourth magnet 15*d* is above the first magnet 15*b*. FIG. 4 shows an offset arrangement in which the fourth magnet 15*d* is above the second magnet 15*b*. FIG. 5 shows another offset arrangement in which the third magnet 15*c* is above the first magnet 15*a*. In all these orientations, the magnetic field interaction between the magnets generates a repulsive force between the male plug 3 and the female receptacle 1.

Figure 6:
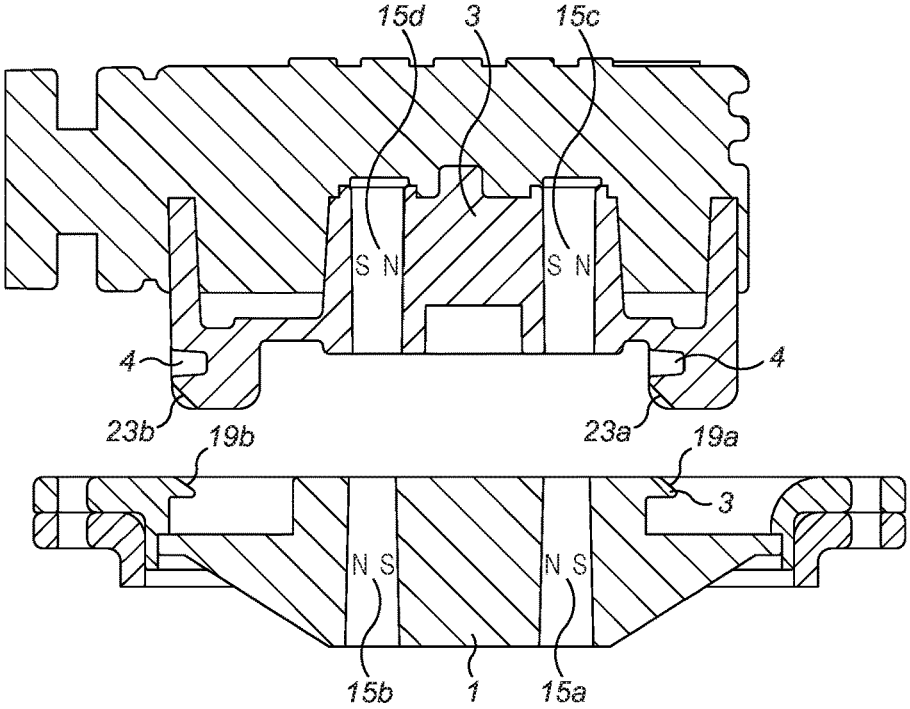
FIGS. 6 and 7 show the female part and the male part arranged relative to each other with correct alignment.
Figure 7:
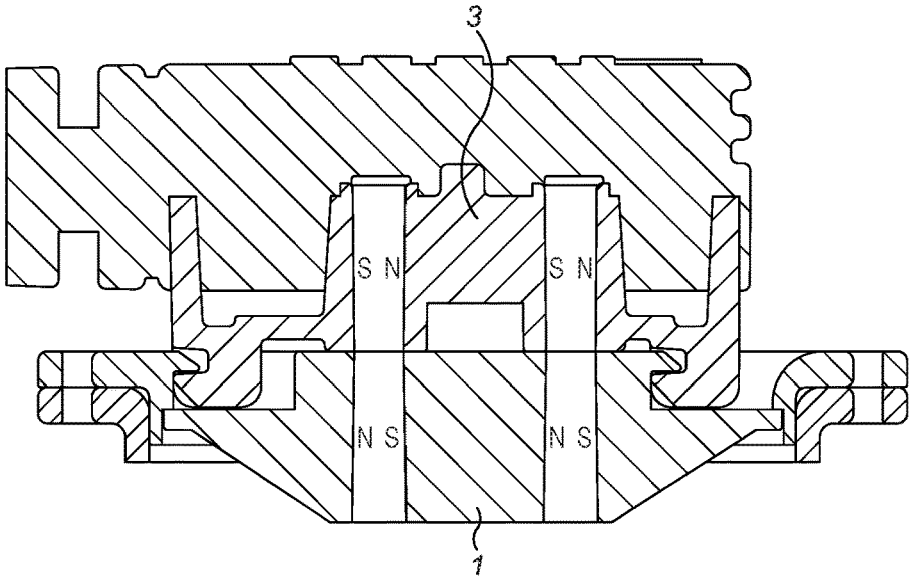
Figure 8:
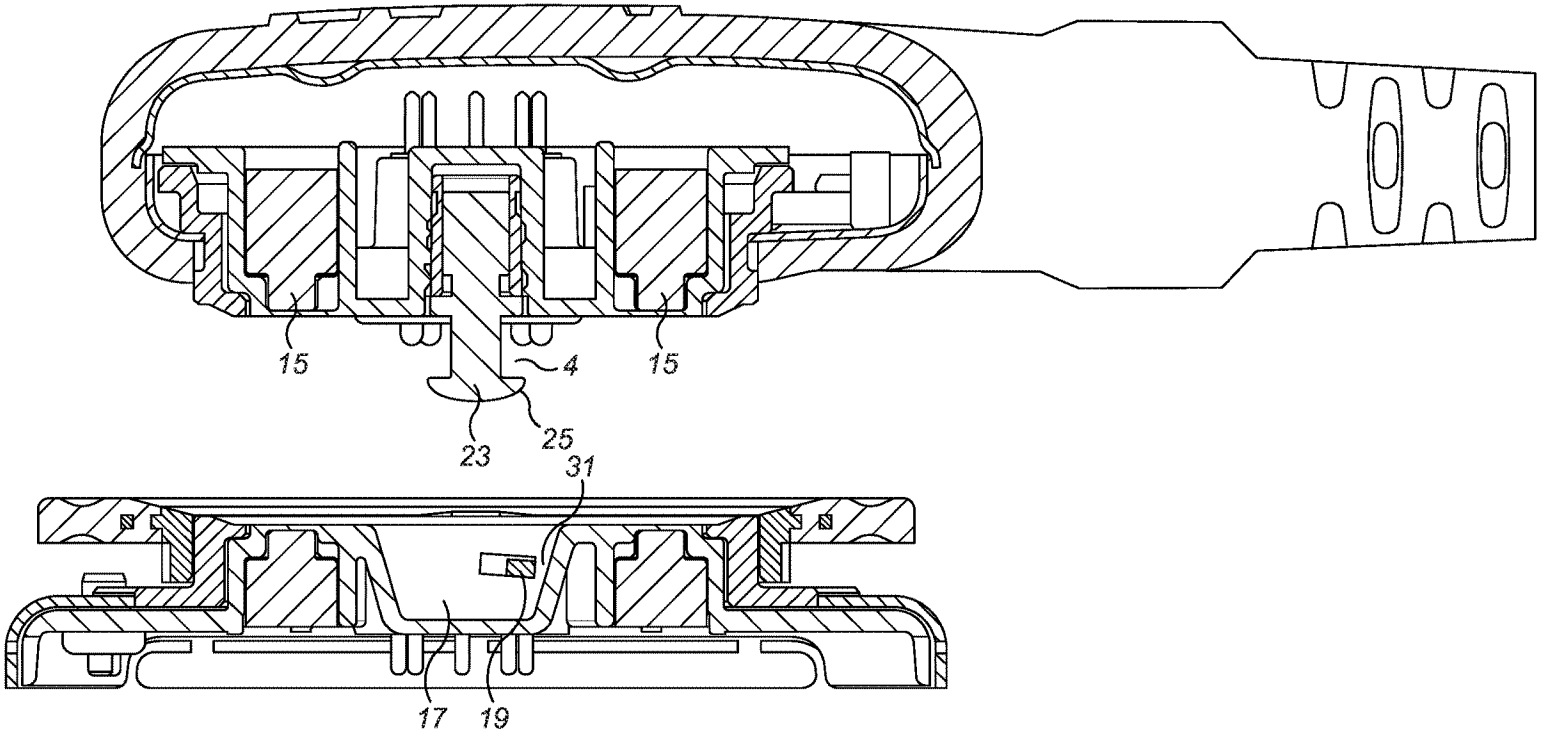
FIGS. 8 to 11 show cross-sectional views of a female part and a male part of a connector assembly of a second embodiment of the invention in different configurations during attachment of the male part to the female part.

FIG. 6 schematically shows the male plug 3 positioned nearby the female receptacle 1 in the correct orientation. In this orientation, the first magnet 15*a* faces the third magnet 15*c* and the second magnet 15*b* faces the fourth magnet 15*d*. As a result, the magnetic field interaction between the magnets generates an attractive force that aligns and connects the male plug 3 to the female receptacle 1.

In order to separate the male plug 3 from the female receptacle 1, the male plug 3 must first be moved transversely in the direction A indicated in FIG. 1 to disengage the lug portions 21 from under the lip portions 19, and then the male plug 3 can be moved perpendicularly away from the female receptacle 1.

FIGS. 8 to 11 show cross-sectional views through a connector assembly forming a second embodiment of the invention. Components of the second embodiment with analogous functions as components of the first embodiment have been referenced with the same numerals. The main differences between the first embodiment and the second embodiment are in the projections 23 and the recesses 17. In particular, in the second embodiment the projections 23 are in the form of two pins, one of which is shown in cross-section in FIGS. 8 to 11. Each pin 23 has a head portion with a curved surface angled to facilitate the pin 23 following a lip 19 (one of which is shown in cross-section in FIGS. 8 to 11) into the corresponding recess 17.

As shown, the recess 17 is in communication with a passage 31 via which debris can exit the recess 17. The side wall of the passage 31 is angled to facilitate the exiting of ferrous debris via the passage 31 under magnetic attraction provided by the magnets 15.

Figure 9:
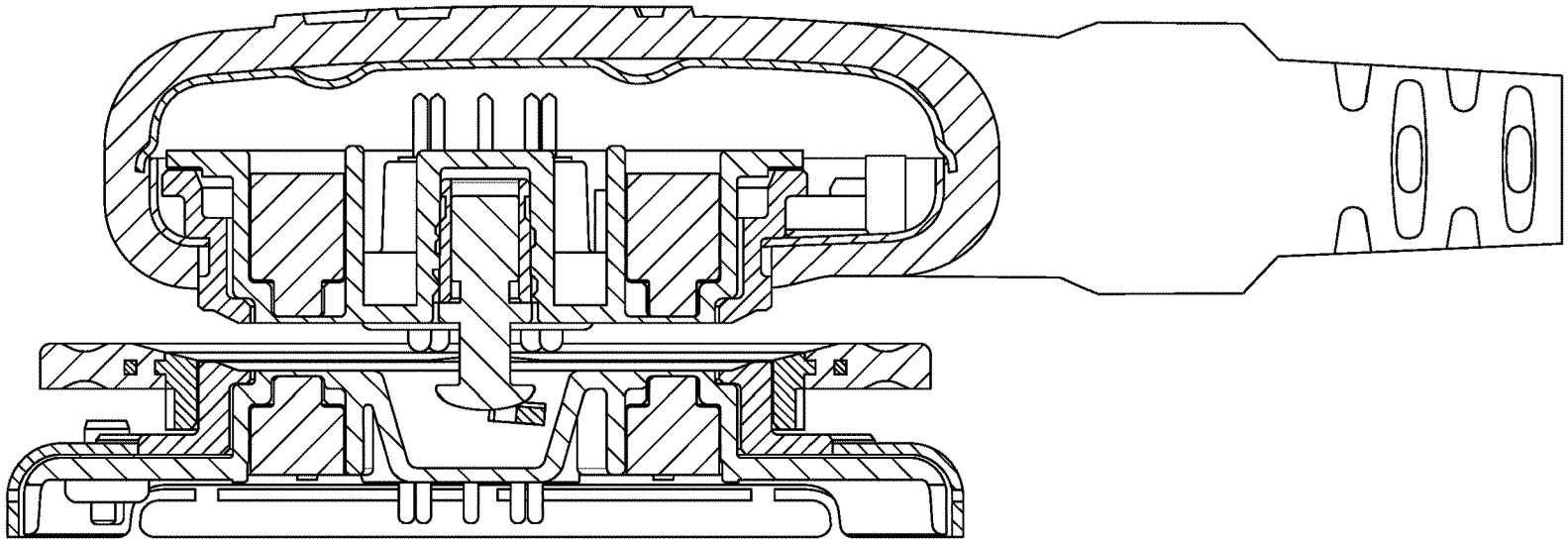
Figure 10:
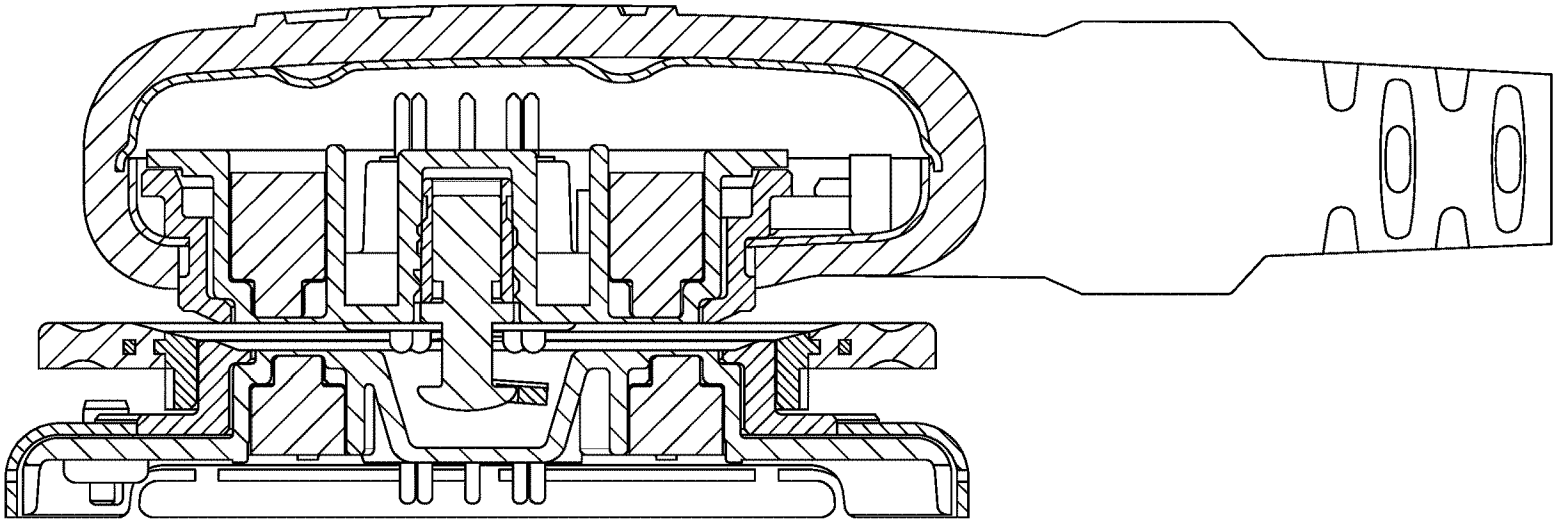
Figure 11:
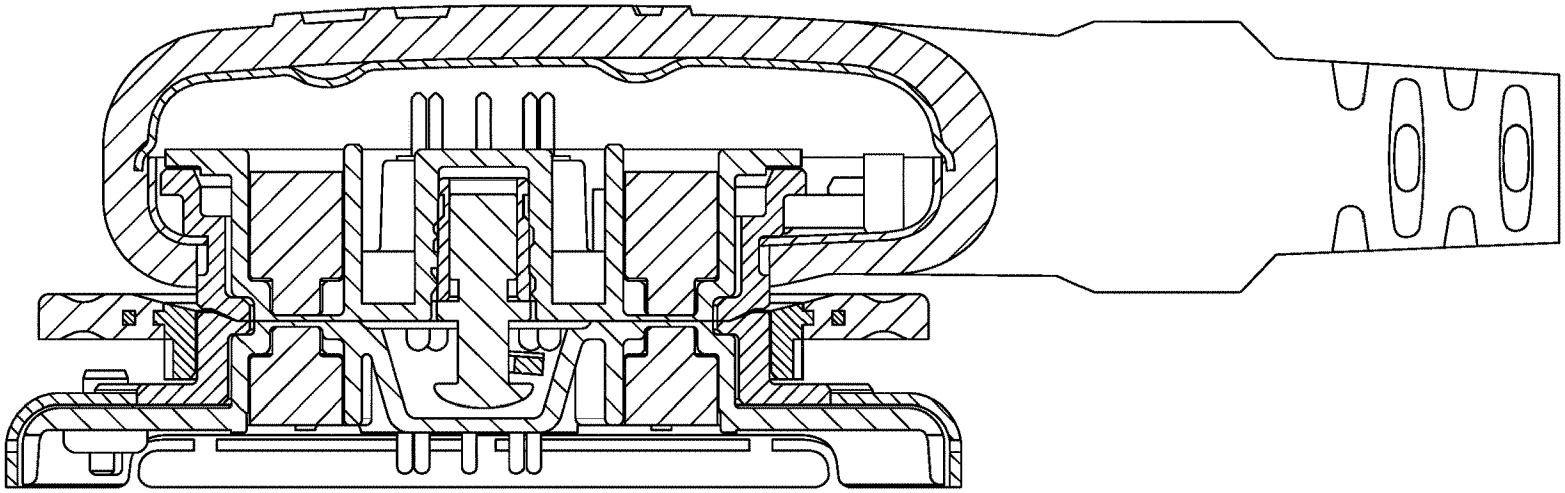

As shown in FIGS. 9 and 10, on engagement the pin 23 traverses over the lip 19, which is angled so that during engagement the contact point between the pin 23 and the lip 19 moves away from the plane of the receptacle. As shown in FIG. 11, at the end of the traverse the pin 23 enters the recess and is moved by magnetic attraction under the lip 19, in a similar manner to the first embodiment. The angling of the lip 19 facilitates the disengagement of the male plug 3 from the receptacle 5 in this embodiment, in which the lip 19 is formed of a small plate of metallic material.

As in the first embodiment, engagement and disengagement of the male plug 3 and the female receptacle 5 involves no deformation/flexing of either component.

Modifications and Further Embodiments

In the above embodiments, the connector assembly provides electrical connectivity. It will be appreciated that the invention could also be used in connector assemblies for other types of connectivity. For example, in an alternative embodiment the invention is utilized in a connector assembly for establishing optical connectivity to allow optical signals to pass, via optical waveguides such as optical fibers, from a first optical component to a second optical component.

It will be appreciated that the invention will work with different numbers of projections and recesses, although preferably there are at least two projections and at least two recesses. It is not necessary that all the projections are provided on the same connector part to form a male plug, as each connector part may have both projections and recesses.

In the illustrated embodiment, the male plug 3 is guided by the lip portions 19 along a generally linear path under the influence of the attractive magnetic force. In this way, the lip portion provides a guide track. In an alternative embodiment, the female receptacle has a circular recess with a helical guide track which guides, under the influence of the attractive magnetic force, one or more followers provided on one or more arcuate projections on the male plug in a generally rotary direction to a portion of the recess in which the followers are retained in position with the male plug connected to the female receptacle in correct alignment (in a manner similar to a bayonet connector). In this embodiment, to effect release of the male plug 3 from the female receptacle, a twisting action is performed on the male plug 3.

In the illustrated embodiment, the male plug 3 is connected to a cable. This cable may be connected to a textile electrical component, a standard (i.e. non-textile) electrical component or to a wire loom provided in another system (e.g. a vehicle). The male plug need not be connected to a cable. For example, the male plug could form an integral part of a textile electrical component.

In the described embodiments, the magnets 15 are permanent magnets. It will be appreciated that alternatively one or more of the magnets could be electromagnets.

The above embodiments are to be understood as illustrative examples of the invention. Further embodiments of the invention are envisaged. In particular, equivalents and modifications not described above may also be employed without departing from the scope of the invention, which is defined in the accompanying claims.

What is claimed is:

1. A connector assembly comprising a first connector part and a second connector part, at least one of the first connector part and the second connector part comprising at least one magnet for providing an attractive force between the first connector part and the second connector part to align the first connector part and the second connector part in a connected state, wherein the first connector part comprises a guide track and the second connector part comprises a follower, the guide track being shaped to guide movement of the follower, under the influence of said attractive force, to a retaining position in which the follower engages an abutment surface on the first connector part without any deformation or flexing of the first connector part or the second connector part, to provide a retaining mechanism for retaining the first connector part and the second connector part in the connected state.

2. The connector assembly of claim 1, wherein the guide track comprises a lip portion overhanging a portion of a recess in the first connector par, the lip portion having an outer surface and an inner surface facing the recess, and the follower comprises a lug portion, wherein the lip portion and the lug portion are shaped to guide movement of the lug portion, under the influence of said attractive force, around the outer surface of the lip portion and into the recess to provide the retaining mechanism.

3. The connector assembly of claim 2, wherein the lip portion is arranged to guide the lug portion into the recess via a first passage, and wherein the recess further comprises a second passage for egress of debris.

4. The connector assembly of claim 3, wherein the recess is shaped such that a magnetic force associated with said at least one magnet attracts ferrous debris out of the recess via the second passage.

5. The connector assembly of claim 2, the first connector part comprising a first planar connection surface and the second connector part comprising a second planar connection surface, wherein the first planar connection surface is aligned adjacent to the second planar connection surface in the connected state by said attractive force.

6. The connector assembly of claim 5, wherein the lip portion has a first surface and a second surface interconnected at an edge, the first surface facing away from the first connector part and the second surface facing into the first connector part, the first surface being angled with respect to the first planar connection surface to provide a reaction force on the lug portion of the second connector part having a component in the plane of the first planar connection surface to guide the second connector part to said edge.

7. The connector assembly of claim 6, wherein said attractive force has a component in the plane of the first connection surface to guide the lug portion of the second connector part from the edge in a direction along the second surface of the lip portion.

8. The connector assembly of claim 6, wherein the second surface of the lip portion is substantially parallel to the plane of the first planar connection surface, wherein in the connected state the second surface inhibits movement of the second connector part away from the first connector part in a direction perpendicular to the first planar connection surface.

9. The connector assembly of claim 1, wherein the first connector part comprises two linear lip portions arranged parallel to each other, and wherein the second connector part comprises two linear lug portions arranged parallel to each other and configured to engage respective different ones of the two linear lip portions.

10. The connector assembly of claim 5, wherein the first connector part has a first magnet having a first magnetic axis aligned parallel to the plane of the first planar connection surface and the second connector part has a second magnet having a second magnetic axis aligned parallel to the second planar connection surface, wherein when the first magnetic axis and the second magnetic axis are aligned in opposite directions the first magnet and the second magnet are attracted to each other and wherein when the first magnetic axis and the second magnetic axis are aligned in the same direction the first magnet and the second magnet are repelled from each other.

11. A textile electrical component comprising a connector part as claimed in claim 1.

12. A textile electrical component as claimed in claim 11, wherein the textile electrical component is wearable.

13. A textile electrical component as claimed in claim 11, wherein the textile electrical component comprises a wire loom.

* * * * *